US011602233B2

(12) United States Patent
Ngoy et al.

(10) Patent No.: US 11,602,233 B2
(45) Date of Patent: Mar. 14, 2023

(54) DIGITAL SHADOW BOX

(71) Applicant: Kool Brands, LLC

(72) Inventors: Titi Ngoy, San Gabriel, CA (US); Roney Pang, Rowland Heights, CA (US)

(73) Assignee: Kool Brands, LLC, Reno, NV (US)

( * ) Notice: Subject to any disclaimer, the term of this patent is extended or adjusted under 35 U.S.C. 154(b) by 0 days.

(21) Appl. No.: 16/854,735

(22) Filed: Apr. 21, 2020

(65) Prior Publication Data

US 2020/0329890 A1 Oct. 22, 2020

Related U.S. Application Data

(60) Provisional application No. 62/836,708, filed on Apr. 21, 2019.

(51) Int. Cl.
*A47G 1/12* (2006.01)
*A47G 1/06* (2006.01)

(52) U.S. Cl.
CPC ..... *A47G 1/0622* (2013.01); *A47G 1/12* (2013.01)

(58) Field of Classification Search
CPC ..... A47G 1/0622; A47G 1/12; A47G 1/0616; A47G 1/065; G09F 9/306; G09F 13/04
USPC ..... 40/455, 465
See application file for complete search history.

(56) References Cited

U.S. PATENT DOCUMENTS 2,345,998 A * 4/1944 Apuzzo ..... G09F 19/12 40/444
3,666,936 A 5/1972 Webster, Jr. et al.
3,806,722 A 4/1974 Peake et al.
3,897,645 A * 8/1975 Scheyer ..... B44C 3/025 40/800
5,276,599 A * 1/1994 Neeley ..... A47B 97/00 362/301
6,042,243 A * 3/2000 Grill ..... G09F 13/0413 362/125
7,984,578 B2 7/2011 Kabel
2001/0041975 A1 11/2001 Loudermilk
2004/0226209 A1 11/2004 Ayala
2008/0204258 A1 8/2008 Dayton et al.
2009/0100732 A1 4/2009 Seidler
2012/0169718 A1* 7/2012 Schindler ..... H04N 13/395 345/419

(Continued)

FOREIGN PATENT DOCUMENTS

JP 2016212335 12/2016
KR 200318355 6/2003

(Continued)

OTHER PUBLICATIONS

Vocca Pro (Voca) Dec. 15, 2015 (Dec. 15, 2015) (online) retrieved from <URL:https//ww.youtube.com/watch?v=wgmklsbyqbc> entire document, especially demonstration 0:14-0:36.

(Continued)

*Primary Examiner* — Cassandra Davis

(74) *Attorney, Agent, or Firm* — Ellenoff Grossman & Schole LLP; Alex Korona; Danielle Cohen

(57) ABSTRACT

The present invention generally relates to display structures, and more particularly to a shadow box device for displaying items of artwork to create an impression that a piece of artwork is three-dimensional. The device may include light and sound modules which may be configured to interact with the surroundings of the device.

12 Claims, 4 Drawing Sheets

(56) References Cited

U.S. PATENT DOCUMENTS

| | | | | |
|---|---|---|---|---|
| 2013/0104433 | A1* | 5/2013 | Justin, III | G03H 1/0005 40/725 |
| 2016/0192791 | A1* | 7/2016 | Gao | A47G 1/0616 40/714 |
| 2018/0012260 | A1* | 1/2018 | Bazos | G09F 13/18 |
| 2018/0012476 | A1* | 1/2018 | Haynes | A47G 29/1214 |
| 2018/0303252 | A1 | 10/2018 | Demircift et al. | |

FOREIGN PATENT DOCUMENTS

| | | | | |
|---|---|---|---|---|
| KR | 20030062124 | | 7/2003 | |
| KR | 200369165 | | 12/2004 | |
| KR | 20180001738 | | 6/2018 | |
| WO | WO-8401654 | A1 * | 4/1984 | G09F 13/10 |
| WO | 9428529 | | 12/1994 | |

OTHER PUBLICATIONS

Extended European Search Report for EU App. No. 20795509.7, dated Nov. 30, 2022.

* cited by examiner

DIGITAL SHADOW BOX

CROSS-REFERENCE TO RELATED APPLICATION

The present application claims the benefit of U.S. Provisional Application No. 62/836,708, filed on Apr. 21, 2019.

FIELD OF THE INVENTION

The present invention generally relates to display structures, and more particularly to a shadow box device for displaying items of artwork to create an impression that a piece of artwork is three-dimensional. The device may include light and sound modules which may be configured to interact with the surroundings of the device in coordination with the piece of artwork being displayed.

BACKGROUND OF THE INVENTION

Shadow boxes are used to display works of art such as images (for example, photographs or prints), objects of memorabilia, as well as figures, scale models and landscapes. Shadow boxes are constructed to provide a device for dramatizing images and the like in order to focus attention on the display and establish an illusion through which a work may be advantageously and favorably viewed.

The present invention provides a shadow box incorporating digital modules to control the lighting and sound of the shadow box display which may be manipulated to contribute to the scene development and illusions created by the shadow box device. These and other features and advantages of the present invention will be explained and will become obvious to one skilled in the art through the summary of the invention that follows.

SUMMARY OF THE INVENTION

The present invention provides a three-dimensional artwork display for photographs, pictures and the like works of art to be mounted within a boxed frame to give the appearance that the artwork is three dimensional.

A second object of the present invention is to provide a shadow box device which has lighting and sound features which may be configured to display lights and/or sounds, as desired by a user, in coordination with the artwork being displayed.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED DESCRIPTION OF THE INVENTION

Figure 1:
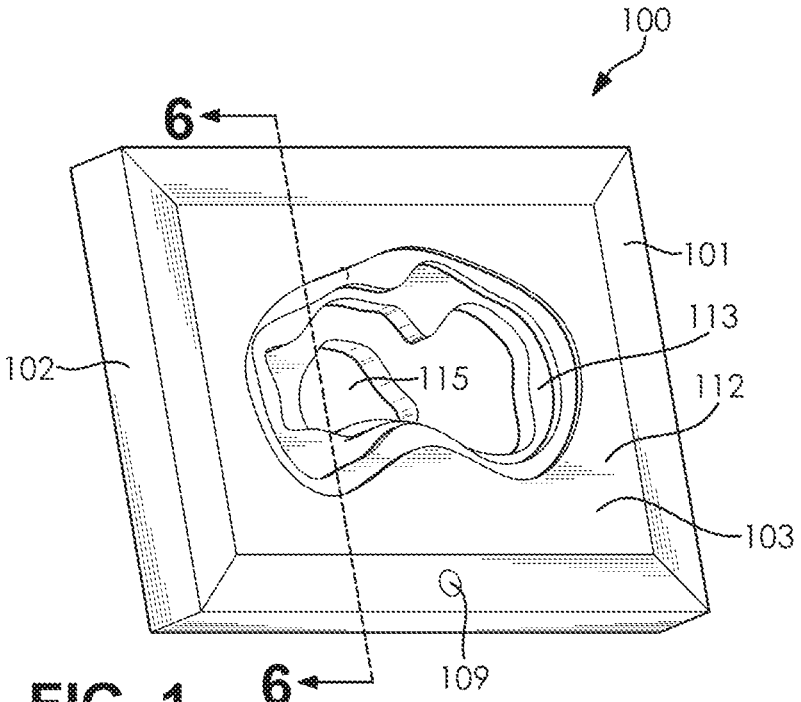
FIG. 1 is a front perspective vide of a shadow box device in accordance with an embodiment of the present invention.

In the Summary above, the Detailed Description, the Claims below, and in the accompanying drawings, reference is made to particular features of the present invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Whenever a reference herein is made to a method comprising two or more defined steps, the defined steps can be carried out in any order or simultaneously (except where the context excludes that possibility), and the method can include one or more other steps which are carried out before any of the defined steps, between two of the defined steps, or after all of the defined steps (except where context excludes that possibility).

The present invention generally relates to a shadow box display. Specifically, embodiments of the present invention relate to a framed shadow box which provides a means to display works of art to have depth and is enabled with digital modifications, permitting a user to choose from a selection of lighting and sound display settings.

Embodiments of the present invention are generally directed toward a shadow box for displaying three-dimensional artistic works. The shadow box device of the present invention may be configured to display lights and produce sound effects or music, as desired by a user. The construct enables a user to select and adjust sound and lighting display options.

In accordance with an embodiment of the present invention, the shadow box device may have a case or box structure formed as a frame having a depth and perimeter side walls. The device may optionally include a housing for storing the electrical components of the shadow box. According to embodiments of the present invention, the electrical components of the device include but are not limited to a lighting system, a sound system, a voice command system, and/or a sensor. Generally at the front of the frame or box structure is a transparent material such as glass, plexiglass or plastic which acts as a cover for the contents within the box structure, allowing the artwork within the box to be placed on display.

In accordance with embodiments of the present invention, a three-dimensional display may be created from a single image that is reproduced, with selected portions of the original image overlayed at a distance from an innermost picture. In an exemplary embodiment, a plurality of layers may be created based on a single image. For example, the outermost layer of the image may include a portion of the original image. The next layer may include another portion of the original image. The innermost layer may include the entirety of the original image. In some embodiments, the several layers are created from a single original image, wherein portions of the original image are overlayed at a predetermined distance from one another. In some embodiments, the several layers are distinct images overlayed atop the innermost layer, wherein each layer is overlayed atop the innermost layer at a predetermined distance.

According to embodiments of the present invention, each layer of the shadow box construct may be distanced from the layer below it by a platform placed in a predetermined orientation and location. Such platforms may provide a depth to the layered image to create an illusion that the collective work is three-dimensional. In some embodiments, a backlight may be used to shine light through the layers. The backlight may create a shadowing effect to dramatize the illusion of depth of the three-dimensional image. In some embodiments, the shadow box may be configured with a light display such as a colorful light configured to illuminate the display in coordination with the scene or image depicted in the shadow box display. In some embodiments, a sound unit may be incorporated in the construct to provide scenery sounds, in coordination with the scene or image depicted in the shadow box display. In some embodiments, the shadow box device may be modified to include other sensory devices such as a module for producing a smell, in coordination with the scene or image depicted in the shadow box display.

According to embodiments of the present invention, the shadow box device may comprise a power source, a motion sensor, a lighting module, and a sound module. In some embodiments, a portion of the electrical components of the device are disposed within the housing included within the shadow box device. In some embodiments, the shadow box device further comprises a communication device. A microprocessor may also be provided in the housing for providing control of the shadow box device. A power source may be disposed within the housing of the device to provide electrical power to the motion sensor, lighting system, sound system and/or the communication device.

According to embodiments of the present invention two or more shadow box devices may be configured to connect or attach to each other to form a collage, for example, to group the shadow boxes together to depict a collective scene. For example, the collective scene may be a beach scene wherein a first shadow box, for example, a top shadow box, depicts the sky, sun, and part of the water, while a second shadow box, for example, a bottom shadow box, depicts a bottom half of the water and the sand to complete the scene. In some scenarios, the shadow boxes may be standalone shadow boxes, but when combined, the shadow boxes may depict a bigger scene.

According to embodiments of the present invention, the shadow box devices may include connectors configured to connect a first shadow box to a second shadow box. In any embodiment, a first shadow box device may be connected via one or more connectors to one or more additional shadow boxes. The connectors may be pins, screws, adhesives, or any other connector suitable for connecting the shadow boxes. In some embodiments, the connectors may include electronic components configured to convey and/or transfer data among the shadow box devices. In any embodiment, the shadow boxes may transmit data to one another via wired or wireless technology. In some examples, the shadow boxes transmit data to one another via Bluetooth® technology.

Figure 4:
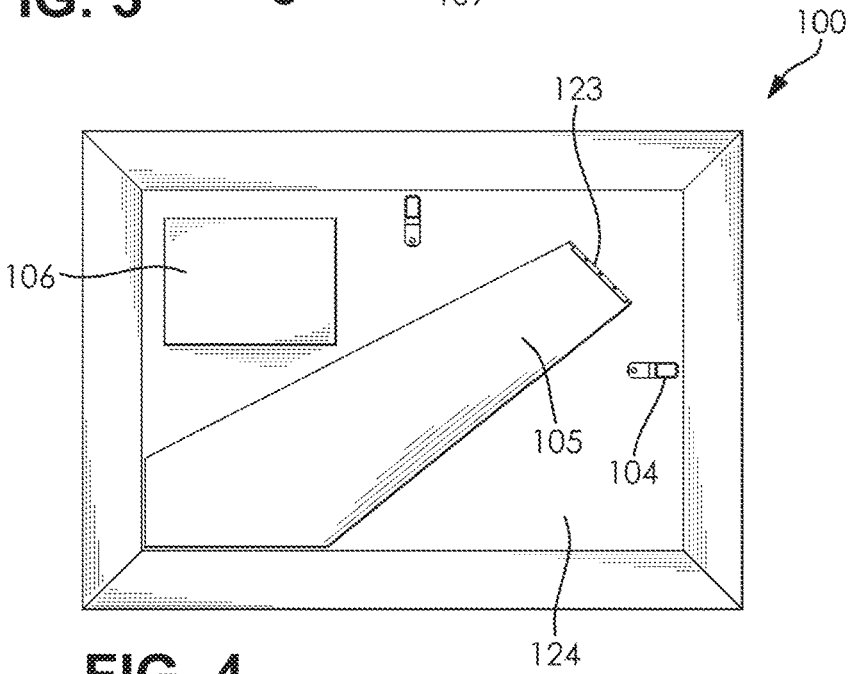
FIG. 4 is a back view of a shadow box in accordance with an embodiment of the present invention.
Figure 5:
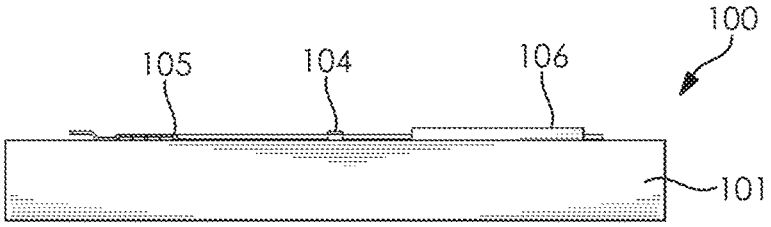
FIG. 5 is a side view of a shadow box device in accordance with an embodiment of the present invention.

Referring now to FIGS. 1-4, a shadow box device 100, in accordance with embodiments of the present invention, is shown. The shadow box device 100, may be comprised of a frame 101 having perimeter side walls 102 and a front wall or surface 103. Front surface 103 may be generally constructed to engage with the perimeter side walls 102. Front surface 103 may be comprised of a material such as glass, plexiglass or plastic which acts as a cover for the contents within the box structure and allows for a work within the shadow box 100 to be on display. The frame 101 may be comprised of wood, plastic or metal, or any similar material capable of framing a piece of artwork. As shown in FIG. 4, in some embodiments, the back side or rear wall 124 of the shadow box device 100 includes at least one hook 104 or any similar means for attaching the device to a wall or similar vertical support structure. In some embodiments, the back side of the shadow box device 100 includes a hinge 123 engaged with a support 105, for supporting the device 100 to stand substantially vertically atop a table, desk or any similarly substantial horizontal support structure.

Figure 6:
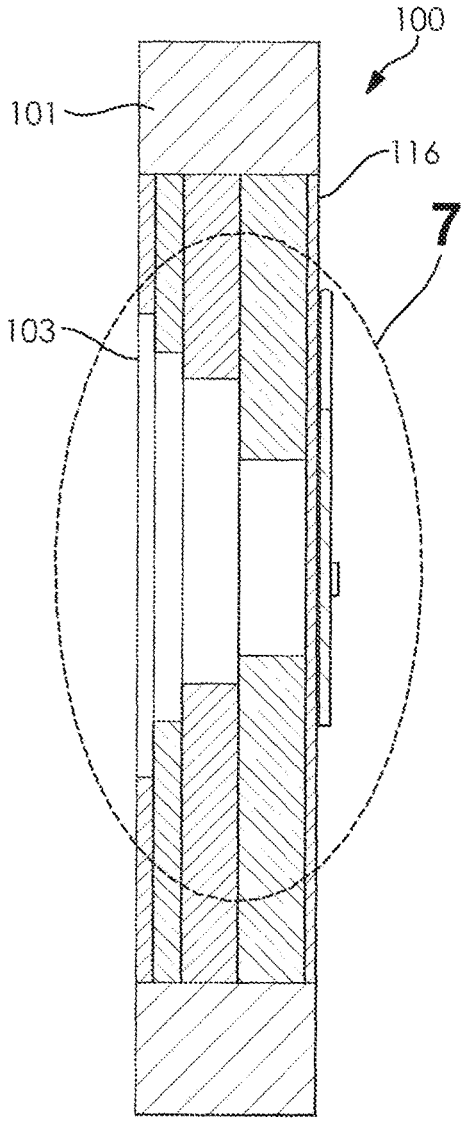
FIG. 6 is a cross-sectional side view of a three-dimensional image for display in a shadow box device in accordance with an embodiment of the present invention.
Figure 7:
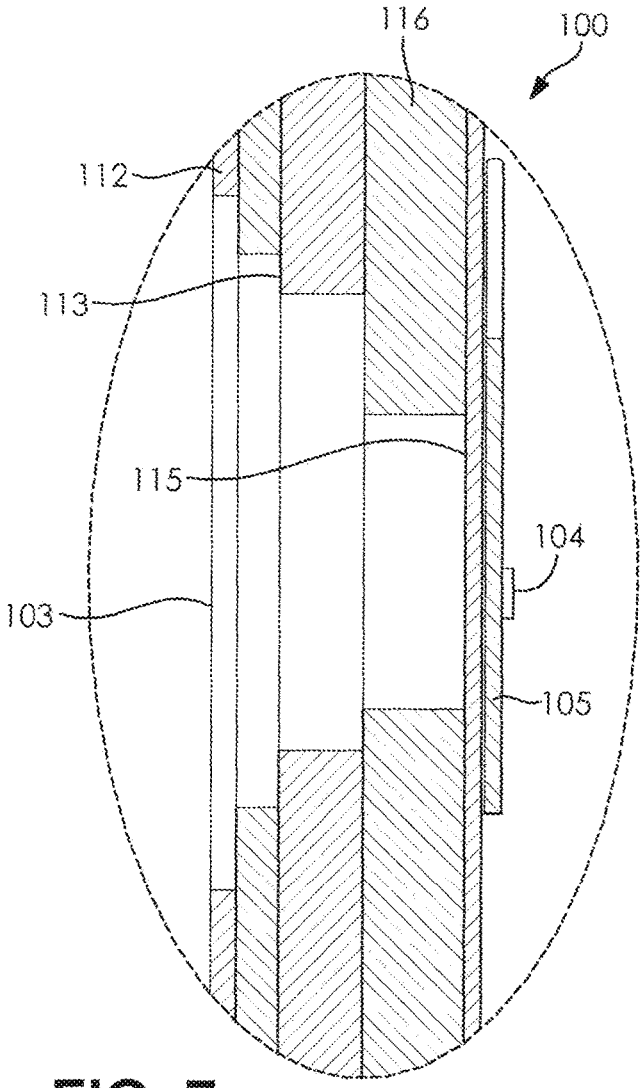
FIG. 7 is an enlarged cross-sectional side view of a three-dimensional image for display in a shadow box device in accordance with an embodiment of the present invention.

As shown in FIGS. 1-4, in accordance with embodiments of the present invention, a three-dimensional display may be created from a single image that is reproduced, with selected portions of the original image overlayed at a distance from an innermost layer 115. In an exemplary embodiment, multiple layers may be created based on a single image. As shown in FIGS. 6 and 7, the outermost layer 112 of the image may include a portion of the original image. A middle layer 113, may include a portion of the original image. As shown in FIGS. 6 and 7, a piece of three-dimensional artwork may be comprised of five layers. In some embodiments, each layer may be primarily attached to the innermost layer 115 or primarily attached to the layer directly beneath each respective layer. In some embodiments, the several layers may be overlayed at a predetermined distance from one another.

In some embodiments of the present invention, a three-dimensional display may be created from a collection of distinct images, or portions thereof, substantially layered atop one another. For example, a first image may be used as a bottommost layer, and a second image may be layered atop the bottommost layer at a predetermined distance. Several layers may be layered atop the bottommost layer or atop one another in the same or similar nature to produce a three-dimensional image. According to embodiments of the present invention, similar image layering configurations may be utilized to create a three-dimensional display.

As shown in FIGS. 6 and 7, each layer of the shadow box construct may be distanced from the layer immediately below it by a platform 116 placed in a predetermined orientation and location. Such platforms 116 provide a height to each of the layered images to create an illusion that the collective work is three-dimensional. According to embodiments of the present invention, the layers of the three-dimensional display may be similarly distanced from each other by any other similarly suitable mechanism capable of providing depth or height, as the case may be, to a three-dimensional image.

In some embodiments, a backlight 117 may be used to shine light through the layers. The backlight 117 may create a shadowing effect to dramatize the illusion of depth of the three-dimensional image. In some embodiments, the shadow box may be configured with a light display 107 such as a colorful light configured to illuminate the display in coordination with the scene or image depicted in the shadow box display. In some embodiments, a sound unit 108 may be incorporated in the construct to provide scenery sounds, in coordination with the scene or image depicted in the shadow box display.

Figure 2:
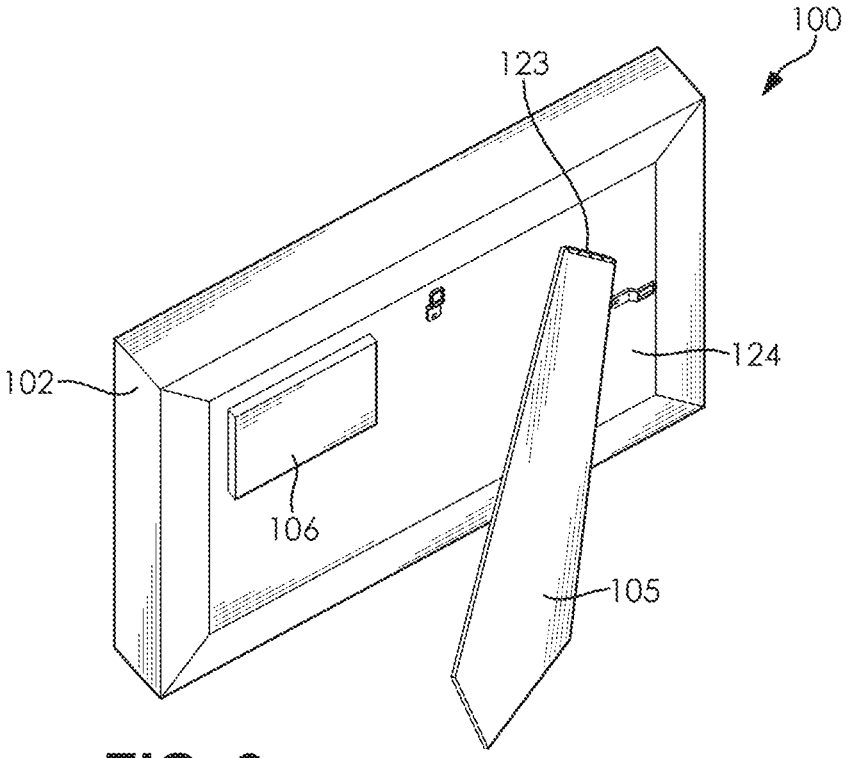
FIG. 2 is a back perspective vide of a shadow box device in accordance with an embodiment of the present invention.
Figure 3:
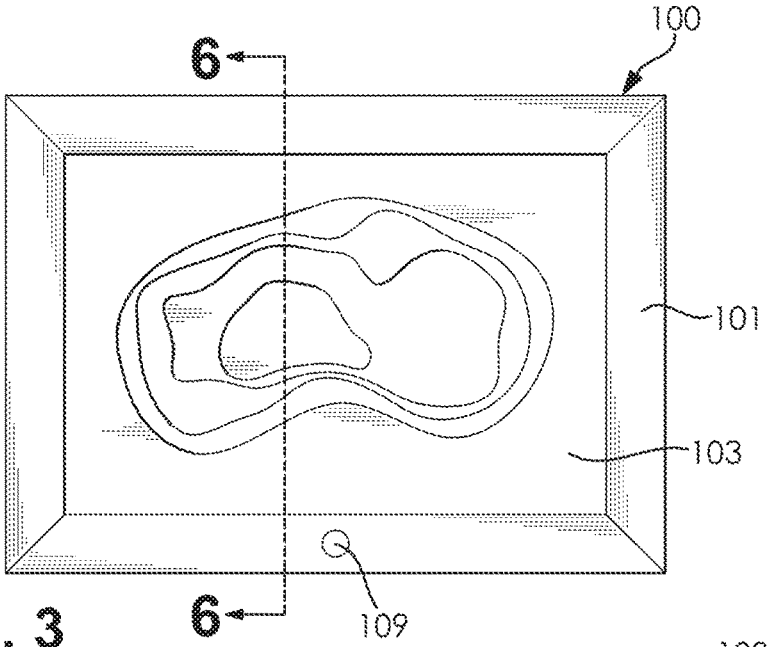
FIG. 3 is a front view of a shadow box device in accordance with an embodiment of the present invention.

As shown in FIGS. 2 and 4, the electrical components of the shadow box device 100 may be disposed within a housing 106. For example, the electrical components of a light display 107, sound unit 108, motion sensor 109 and power source 110 may be disposed within the housing 106. In some embodiments, the electrical components of the shadow box device 100 are integrated within the frame 101. In some embodiments, a portion of the electrical components of the shadow box device 100 are disposed within the housing 106 and another portion of the electrical components are integrated within the frame 101. According to embodiments of the present invention, similar storage configurations may be utilized to store the electrical components of the shadow box device 100.

According to embodiments of the present invention, a light display 107 may be incorporated in the shadow box device 100 and for the displaying of lights on or through the front surface 103 in conjunction with the artwork on display within the box construct. In some embodiments, the lights of the light display are arranged behind the three-dimensional artwork within the shadow box, for example, to create an illusion that portions of the artwork are moving and/or to create a shadowing effect for the artwork within the shadow box. In an exemplary embodiment, the light display 107 is comprised of an array of light-emitting diodes (LEDs) 111 that are individually logically addressable, such that the array is capable of displaying shapes and/or patterns.

Light display 107 may comprise a circuit board 110, for example a printed circuit board (PCB), formed of a substrate such as polyimide film, having conductive paths and a plurality of LEDs 111 installed thereon. In some embodiments, the light display 107 includes a control circuit unit for controlling the color, intensity and timing of LEDs 111. In some embodiments, the LEDs are configured to be visible under a variety of lighting conditions, from dark conditions, such as a darkened or dimly lit indoor room or at night outdoors, to bright conditions, such as a brightly lighted indoor room or sunny daytime conditions.

While the shadow box 100 shown in the figures is generally rectangular with straight sides, that need not be its shape in all embodiments. In some embodiments, shadow box 100 may have any number of perimeter sides. For example, shadow box 100 may be designed in a generally pentagonal, hexagonal, or septagonal shape. In some embodiments, the shadow box 100 may be generally circular or oval-shaped.

Figure 8:
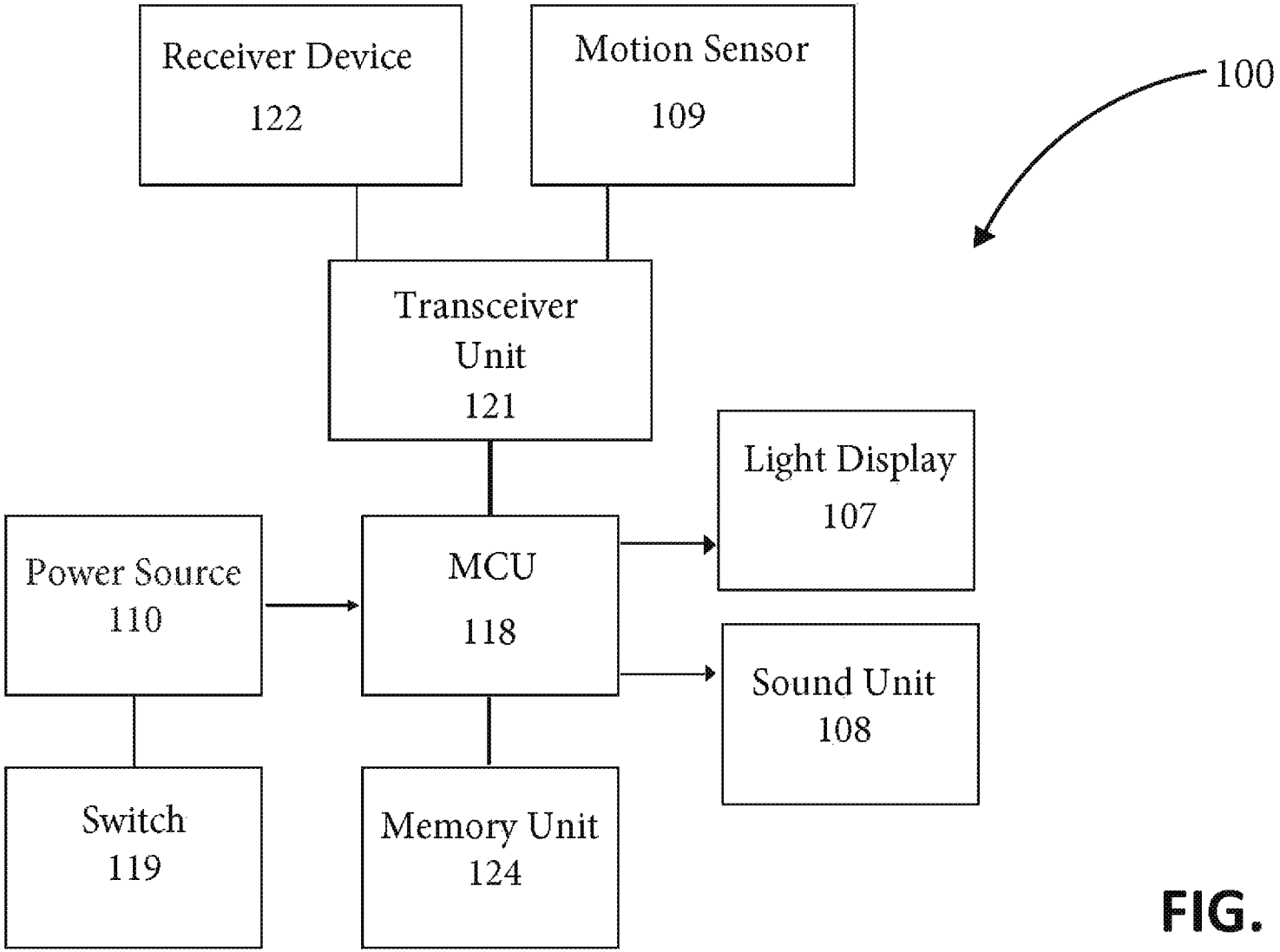
FIG. 8 is a schematic diagram of the electronic components of a shadow box device in accordance with an embodiment of the present invention.

FIG. 8 is a schematic diagram of the control electronics for the light display 107. In some embodiments, the function of light display 107 is controlled by a microcontroller unit (MCU) 118, which draws power from a power source 110. In some embodiments, the light display 107 and sound unit 108 may receive instructions from the MCU 118 which may receive instructions from remote programming devices through a transceiver unit 121 that is coupled to a receiver device 122, such as an antenna, of an appropriate configuration. In some embodiments, the transceiver unit 121 is a Bluetooth® transceiver unit capable of receiving instructions and transmitting feedback. In some embodiments, other types of transceivers may provide different wireless and other communication capabilities. For example, WiFi® transceivers may be utilized to provide higher band-width or longer-range communication. Similarly, for example, conventional cellular transceivers for wireless data communications using a cellular network may equally be utilized. In some embodiments, multiple transceiver units 121 may be utilized for different communication modalities. In some embodiments, the shadow box device 100 may include a local programing device such as a physical memory unit having a number of pre-programmed, selectable images, patterns and/or sounds and a selector switch for the toggling between the selection of pre-programmed images patterns, and/or sounds.

According to embodiments of the present invention, a controller may direct the light display 107 and the sound unit 108. The controller may define what image, pattern and/or sound is to be displayed or played and for how long such image, pattern and/or sound may be displayed or played. In some embodiments, the controller is external to the shadow box device 100 and may communicate with the transceiver unit 121 through a wireless or physical communication protocol, such as Bluetooth®, WiFi®, USB and similar wireless or physical communication protocols. In some embodiments, the controller is located on the device 100 and may communicate with the device 100 through electrical or wired communication protocols. In some embodiments, the controller is a piece of hardware dedicated to the controlling of the light display 107, the sound unit 108 and/or the device 100 as a whole. In some embodiments, the controller is an application or "app" that is implemented on a more general-purpose computing platform. For example, controller may be an application to control light display 107 and sound unit 108, implemented by a computer, tablet, or smartphone. More generally, the controller may be any computing device having the ability to communicate with a light display 107 and a sound unit 108.

As noted above, the controller may be a computing device having the ability to run software applications or apps that allow computing devices to perform the functions attributed to them. As the term is used here, "software" refers to sets of machine-readable instructions that are in a machine-readable form and that, when executed, cause the machine to perform the described tasks. The machine-readable medium may be any type of non-transitory memory, including magnetic disks, optical disks, solid-state drives, programmable read-only memory, external or internal FLASH drives, or any other known form of electronic storage medium.

The power source 110 may be a direct current (DC) power source. In some embodiments, the power source 110 may be batteries, such as rechargeable batteries. For example, the power source 110 can be lithium-ion (Li-ion) batteries or lithium polymer (Li-poly) batteries. However, in embodiments where the power source 110 are batteries, the batteries can be other suitable types (e.g., lead acid, nickel cadmium, nickel metal hydride). In some embodiments, the power source 110 may be a higher voltage alternating current (AC) source, coupled with a transformer, to bring the supplied power to acceptable DC voltage and current levels. In some embodiments, the power source 110 may be capacitors. The power source 110 may be directed to be turned on or off by a switch 119 or similar button capable of starting or stopping to supply power to the power source 104. In some embodiments the power source may be directed to be turned on or off by a voice command module.

According to embodiments of the present invention, a communication device disposed within the shadow box device 100 may enable users to implement a voice command mode. In some embodiments, methods and techniques may be provided to allow the voice to enter the voice command mode and exit from the voice command mode in a manner that is advantageously beneficial to a user. In some embodiments, several techniques may be provided to allow or to cause the communication device to enter into the voice command mode. For example, a user may manually enable the voice command mode by selectively operating a button such as, for example depressing or manipulating a button or switch, a key stroke, a key sequence, or other manual operation. Additionally, the voice command mode may be manually enabled via a spoken command which is configured to instruct the device to enter the voice command mode.

In accordance with embodiments of the present invention, once the device is in the voice command mode, the communication device may interpret one or more voice commands received by the user, and can act on those voice commands. For example, according to one aspect of the invention, the voice command mode may allow the user to vocally input a command, and may convert this vocal input into corresponding device commands. The communication device can communicate these commands across the communication channel. In other words, in the voice command mode, the user can, through voice commands, vocally enter a command without having to physically press a button on the device.

The voice command mode may be implemented in scenarios where the user is accessing a menu-driven system such as, for example, sound systems, lightening systems and other automated systems.

Similar to the entry into voice command mode, several techniques may be provided for exiting the voice command mode. For example, manual exit of the voice command mode may be provided in the form of a physical action performed by the user, or a voice command provided by the user such as, for example, "exit voice command mode."

According to embodiments of the present invention, the power source 110 may provide power to a motion sensor 109. In some embodiments, the motion sensor sends signals to the transceiver unit 115. In some embodiments, the motion sensor 109 may comprise an ultrasonic or infrared sensor to receive motion signals. The motion sensor may use changes in received ultrasonic or infrared energy to indicate movement of a person or an object within an area monitored by the motion sensor 109. The sensitivity of the infrared sensor may be adjusted to a level such that movements of small animals e.g. dog, cat etc. will not trigger the lighting fixture and announcement device.

In embodiments of the present invention with a motion sensor 109, when a person or an object enters into an area monitored by the motion sensor 109, the invisible infrared heat radiation emitted by the moving person or object is detected by the infrared sensor of the motion sensor. The thermal radiation detected may be converted into an electronic signal to engage the lighting device 107 and trigger the sound unit 108 which may be instructed to playback and/or display an announcement, message, image, or pattern. In some embodiments, the motion sensor 109 may be an accelerometer, configured to sense when the shadow box device is in motion and further configured to engage the lighting device 107 and trigger the sound unit 108 which may be instructed to playback and/or display an announcement, message, image, or pattern. Some embodiments may include any similar sensor which is configured to sense motion and engage the lighting display 107 and/or trigger the sound unit 108. In some embodiments, the sound unit 108 may include a sound recording and playback device. Upon activation by the incoming signal from the motion sensor 109, preselected or random lighting effects and/or sound recordings on a magnetic tape or solid state chip may be played back. In some embodiments, the sound unit 108 may transmit an audio signal to an amplifier which is configured to amplify the audio signal. A speaker may be connected to the amplifier to convert the audio signal into sound.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A shadow box device, comprising:

a frame comprising a rear wall opposing and connected by one or more perimeter side walls to a transparent front wall;

a three-dimensional artistic work disposed in the frame and comprising two or more layered images spaced apart by one or more platforms to form a scene, each of the layered images differing from each of the remaining layered images in shape and appearance;

a lighting module at least partially disposed within the frame and configured to selectively illuminate at least a portion of the three-dimensional artwork;

a sound module at least partially disposed within the frame and configured to selectively emit sound corresponding to the scene depicted by the three-dimensional artwork;

a motion sensor in electrical communication with the lighting and sound modules and configured to selectively activate the lighting and sound modules upon sensing motion signals; and one or more connectors, each comprising a wireless transceiver configured to electronically connect the shadow box device to one or more additional of said shadow box devices to form a collage or depict a collective scene with corresponding lights and sounds.

2. The shadow box device of claim 1, wherein the motion sensor is an ultrasonic or infrared sensor configured to activate the lighting and sound modules upon sensing motion signals.

3. The shadow box device of claim 1, wherein the lighting and sound modules are selectively activated by a remote communication device.

4. The shadow box device of claim 3, wherein the communication device is a Smart device.

5. A shadow box device, comprising:

a frame comprising a rear wall opposing and connected by one or more perimeter side walls to a transparent front wall;

a three-dimensional artistic work disposed in the frame and comprising two or more layered images spaced apart by one or more platforms to form a scene, each of the layered images differing from each of the remaining layered images in shape and appearance;

a lighting module at least partially disposed within the frame and configured to selectively illuminate at least a portion of the three-dimensional artwork to selectively create an illusion that at least a portion of the scene is moving;

a sound module at least partially disposed within the frame and configured to selectively emit sound corresponding to the scene depicted by the three-dimensional artwork; and one or more connectors including wireless communication means configured to electronically connect the shadow box device to at least another of said shadow box devices as claimed herein to depict a collective scene.

6. The shadow box device of claim 5, wherein the layered images are a collection of distinct images, layered atop one another.

7. The shadow box device of claim 5, wherein the lighting module includes one or more lights which are arranged behind one or more of the layered images to selectively create a shadowing effect for the layered images within the shadow box.

8. The shadow box device of claim 5, wherein the shadow box device wirelessly connects to one or more shadow box devices to form a collage or depict a collective scene with corresponding lights and sounds.

9. The shadow box device of claim 5, wherein one or more lights of the lighting module are arranged behind one or more of the layered images to selectively create a shadowing effect for a portion the layered images within the shadow box to dramatize the illusion of depth of the three-dimensional image.

10. The shadow box device of claim 5, further comprising a motion sensor in electrical communication with the lighting and sound modules and configured to selectively activate the lighting and sound modules upon sensing motion signals.

11. The shadow box device of claim 5, further comprising a physical memory unit having a number of pre-programmed light and sound effects and a selector switch for the toggling between the selection of light and sound effects.

12. The shadow box device of claim 5, wherein the lighting and sound modules are configured to be controlled by a computer, tablet or smartphone to display one or more of a selection of light and sound effects.

* * * * *